US005991588A

United States Patent [19]

Kraft

[11] Patent Number: 5,991,588

[45] Date of Patent: Nov. 23, 1999

[54] ELECTROPHOTOGRAPHIC TRANSFER PROCESS FOR TRANSFERRING TONER IMAGE ONTO CARBONLESS PAPER

[75] Inventor: Keith A. Kraft, Mendota Heights, Minn.

[73] Assignee: Imation Corp., Oakdale, Minn.

[21] Appl. No.: 08/227,024

[22] Filed: Apr. 12, 1994

[51] Int. Cl.[6] ..... G03G 15/16

[52] U.S. Cl. ..... 399/297; 399/381; 399/411; 430/126; 503/201

[58] Field of Search ..... 355/200, 271, 355/273, 274, 277, 279, 308, 309, 311; 503/201; 399/297, 381, 411, 45; 430/126

[56] References Cited

U.S. PATENT DOCUMENTS

| | | | |
|---|---|---|---|
| 3,516,846 | 6/1970 | Matson | 117/36.2 |
| 3,516,941 | 6/1970 | Matson | 252/316 |
| 4,681,428 | 7/1987 | DeVoy | 355/311 |
| 4,906,605 | 3/1990 | Kraft | 503/215 |
| 4,968,464 | 11/1990 | Kojoh et al. | 264/41 |
| 5,079,068 | 1/1992 | Perrington et al. | 428/192 |
| 5,084,433 | 1/1992 | Kraft | 503/201 |
| 5,115,277 | 5/1992 | Camis | 355/273 |

FOREIGN PATENT DOCUMENTS

| | | | |
|---|---|---|---|
| 0 569 285 A2 | 4/1993 | European Pat. Off. | B41M 5/124 |
| 0185960 | 9/1985 | Japan . | |
| 60-185960 | 9/1985 | Japan . | |

OTHER PUBLICATIONS

D.R. Voas, 1989 Papermakers Conference, pp. 299–302.

Xerox Corporation's "Helpful Facts About Paper," 191 Edition, Section 3–8, entitled "Paper Properties and Xerox Printers".

"Functional Paper Properties in Xerography" (see C.J. Green, Tappi, 1981, 64(5), 79–81).

"Short Grain Web Offset" (Eur. Rotogravure Assoc. Newsl. No. 87, Jan. 1988, pp. 3–4).

*Primary Examiner*—Robert Beatty

[57] ABSTRACT

Carbonless papers manufactured as grain-short paper and wherein the grain direction is parallel to the direction of feed when a toner image is transferred upon in electrophotographic copiers, copier/duplicators, and laser printers results in reduced paper jams, reduced paper curl, and allows the use of lower basis weight papers and the use of non-xerographic grade papers than that normally used in electrophotography.

8 Claims, No Drawings

ELECTROPHOTOGRAPHIC TRANSFER PROCESS FOR TRANSFERRING TONER IMAGE ONTO CARBONLESS PAPER

BACKGROUND OF THE INVENTION

1. Field of the Invention

This invention relates to improved carbonless papers for electrophotographic copiers, copier/duplicators, and laser printers. Carbonless papers manufactured as grain-short paper and wherein the grain direction is parallel to the direction of feed when printed upon in electrophotographic copiers, copier/duplicators, and laser printers results in reduced paper jams, reduced paper curl, and allows the use of lower basis weight papers and the use of non-xerographic grade papers than that normally used in electrophotography.

2. Background of the Art

Carbonless impact marking papers for the transfer of images, (i.e., carbonless copy papers) are papers which are capable of producing an image upon application of pressure.

Products employing this chemistry generally comprise at least two reactants, one reactant known as a color-former and the other reactant known as a developer. Means for preventing the reaction of the two until intended (i.e., until activating pressure is applied) are also provided. This is typically accomplished by encapsulation of one of the reactants. Preferably, a fill solution of the color-forming compound(s) in a hydrophobic solvent is encapsulated or contained in microcapsules. The microcapsules serve the purpose of isolating the reactants from one another and preventing reaction. Once activating pressure is applied to the uncoated surface of a top sheet, such as from a stylus (e.g., a pencil or pen) or business-machine key (e.g., a typewriter or impact printer), the two reactants come into contact under sufficient pressure so that the capsules rupture (i.e., those capsules corresponding to the pattern of applied pressure) and the solution of encapsulated color-former is released and a reaction between the previously separated reactants occurs. Since the color-former and the developer form a deeply colored image when reacted, an image forms on the lower sheet. In general, the resulting reaction will, of course, form a colored image corresponding to the path traveled by the stylus or the pattern of pressure provided by the stylus or key. The term "activating pressure" includes, but is not limited to, pressure applied by hand with a stylus or pressure applied by a business machine key and the terms "encapsulation" and "encapsulated compounds" refer to microcapsules enclosing a fill material.

The chemistry used in carbonless papers is of two general types. In one type of carbonless paper, the image results from the reaction between an encapsulated leuco dye color-former and an acid, a phenolic, or acidic clay developer. In another type of carbonless paper, the image results from the formation of a colored coordination compound by the reaction between an encapsulated ligand color-former and a transition metal developer.

A preferred construction contains an encapsulated color-former dissolved in appropriate hydrophobic solvent(s) within microcapsules and coated with a suitable binder onto a backside of the donor sheet, sometimes referred to as a "coated back" (CB) sheet. A developer, also optionally in a suitable binder such as a starch or latex, is coated onto the front side of the receptor sheet sometimes referred to as a "coated front" (CF) sheet. The term "suitable binder" refers to a material, such as starch or latex, that allows for dispersion of the reactants in a coating on a substrate. Each CB coating contains capsules which, when ruptured, release reagents to produce a color-changing reaction at the adjacent CF coating. The preparation of such capsules and of such carbonless sheets is disclosed by in U.S. Pat. Nos. 3,516,846 and 3,516,941.

A wide variety of processes exist by which microcapsules can be manufactured and a wide variety of capsule materials can be used in making the capsule shells, including gelatin and synthetic polymeric materials. A popular material for shell formation is the product of the polymerization reaction between urea and formaldehyde (UF capsules); between melamine and formaldehyde (MF capsules); or the polycondensation products of monomeric or low molecular weight polymers of dimethylolurea or methylolated urea with aldehydes.

As stated previously, the two sheets are positioned such that the backside of the donor sheet faces the developer coating on the front side of the receptor sheet. In many applications the uncoated surface of the donor (CB) and receptor (CF) sheets contain preprinted information of some type and the activating pressure is generated by means of a pen or other writing instrument used in filling out the form. Thus, the image appearing on the receptor sheet is a copy of the image applied to the front side of the top sheet.

Constructions containing a first substrate surface, on which is coated the encapsulated color-former, and a second substrate surface, on which is coated a developer, are often prepared. The coated first substrate surface is positioned within the construction in contact with the coated second substrate surface. Such a construction is known as a "set" or a "form-set" construction.

Substrates, with one surface, on which is coated the encapsulated color-former, and a second, opposite surface, on which is coated a developer, can be placed between the CF and CB sheets in a construction involving a plurality of substrates. Such sheets are generally referred to herein as "CFB" sheets (i.e., coated front and back sheets). Of course, each side including color-former thereon should be placed in juxtaposition with a sheet having developer thereon. CFB sheets are also typically used in form-sets. In some applications, multiple CFB sheets have been used in form-sets. These contain several intermediate sheets, each having a developer coating on one side and a coating with capsules of color-former on the opposite side. Thus, the sheets in the form-set are sequenced in the order (from top to bottom) CB, CFB(s), and CF. This insures that in each form-set a color former and a color developer will be brought into contact when the microcapsules containing the color-forming material are ruptured by pressure.

An alternative to the use of CB, CF, and CFB sheets is the self-contained (SC), or autogenous, carbonless paper in which both the color-former and developer are applied to the same side of the sheet and/or are incorporated into the fiber lattice of the paper sheet.

Carbonless paper is often used in pre-printed form-sets for preparing multiple copies of receipts, bills, and other business forms and form-sets are prepared by collating from 2 to 8 sheets of carbonless paper. Typically, preprinted forms are compiled into a set or packet such that marking the top form will provide the required number of duplicates. If the number of duplicates is greater than about 3, (i.e., a 4-part form set) the carbonless paper is often manufactured on low basis weight paper so that the pressure exerted on the top sheet will rupture the capsules on the fourth and subsequent sheets in the set. This ability to form a good, dark legible image on a bottom sheet of a form-set from pressure applied on a top sheet, is known as "manifolding."

Form-sets are typically made by applying an adhesive to the edge of a stack of sequenced (i.e., collated) carbonless paper. Each of the coated sheets in a form-set is somewhat porous and permits the adhesive to penetrate into the pores of the paper, such penetration being necessary to attain satisfactory adhesion of sheets within the form-set. Adhesives useful for edge-padding carbonless papers are described, for example, in U.S. Pat. No. 5,079,068.

The adhesively bound papers are then "fanned-out" to be separated into individual form-sets. To promote separation, carbonless copy paper form-sets often have a release coating (for example, a fluorocarbon or silicone coating) applied to at least one of the outer faces of each form-set. These coatings are often referred to as "pad coats." Pad coats function as an abhesive (i.e., a non-adhesive) to provide low adhesion properties to the outer faces of a form-set; as a release agent for the edge-padding adhesive; and to promote "fan-out properties" in edge-padding to allow the adhesively edge-padded stack to "fan-out" or "fan-apart" and separate into individual form-sets upon fanning. Individual form-sets are prepared by stacking the collated carbonless paper, trimming, edge-padding with an edge-padding adhesive, and fanning-out. "Fan-out" is a method of separating a stack or pad of multiple form-sets into individual form-sets.

Often carbonless paper is prepared and packaged in precollated unpadded form-sets. In one version, referred to as a "straight sequence form-set," the sheets are arranged in the order in which they will appear in the finished form. In these form-sets, the coated back sheet (CB) is first in the form-set, the coated front sheet (CF) is last, and the required number of CFB sheets are in between. Alternatively, the paper may be prepared and packaged in precollated form-sets referred to as "reverse sequence form-sets," wherein sheets of various colors and surfaces are arranged opposite to their normal functional order. The coated front sheet (CF) is first in the form-set, the coated back sheet (CB) is last, and the required number of CFB sheets are in between. When sheets are arranged in this manner and are printed in a printer or copier which automatically reverses their sequence, they will end up in the delivery tray in the proper order for subsequent padding and data entry. The type of sequenced form-set used for a particular printing operation is a function of the printing machinery.

Carbonless paper is widely used in the forms industry and carbonless paper forms have been printed in the past by conventional printing techniques such as offset printing, lithography, etc. With the advent of high speed electrophotographic copiers, copier/duplicators, and laser printers having dependable, high capacity collating systems and enhanced copy quality, there has been a movement to replace offset printing equipment located in print shops and large "quick-print" installations with electrophotographic copiers.

Attempts to run conventional carbonless papers through electrophotographic copiers have proved difficult and have resulted in capsule rupture with contamination and damage to copier components, poor machine performance, degraded quality of photocopies, carbonless paper smudging, sheet misfeeds, multi-sheet feeds, paper jams, folded corners, poor manifolding, and curled sheets. For the successful use of carbonless papers in electrophotographic copiers, compatibility of the carbonless paper with the machine is critical. For example, the base sheets upon which carbonless paper coatings are applied to form carbonless papers conventionally imaged via offset printing do not have sufficient stiffness or sufficient sensitivity to machine conditions for curl and moisture control to be handled in copier processors and sorters. Undesirable curl can result in a number of problems within a photocopier and can affect paper feed, transport, image registration, toner fusing and sorter stacking.

Paper jams in high speed copiers, copier/duplicators, and laser printers are particularly troublesome when carbonless papers are used. Jamming destroys the correct sequence of sheets and results in form-sets with missing sheets. The photocopier needs to be opened, the jammed sheets removed, and an additional number of sheets needs to be removed so that the integrity of the stack of form-sets is maintained. This is time consuming and difficult and results in down-time and lost production.

One solution to the problems encountered when carbonless papers are printed upon in high speed photocopiers disclosed in U.S. Pat. No. 4,906,605. That patent discloses the preparation of carbonless papers using high basis weight paper coupled with smaller capsule size and tighter capsule size distribution, along with the elimination of stilt materials containing solvents, allows the successful use of these carbonless papers within copiers such as the Xerox 9000 series copiers and printers.

Another solution to problems encountered when carbonless papers are used in high speed copiers is taught in U.S. Pat. No. 5,084,433. That patent discloses the use of improved solvents compatible with electrophotographic copiers.

A further improvement in preventing capsule rupture and copier damage as well as improving runnability of carbonless paper in photocopiers, copier/duplicators, and laser printers is taught in European Laid Open Patent Application EP 0,569,285. Misfeeding is reduced by preparing carbonless copy paper sheets in which the coefficients of friction of the various faces of the paper are kept within 0.1 units of each other.

Another approach to improved carbonless papers for use in electrophotographic copiers is taught in Copending U.S. patent application Ser. No. 08/047,848, filed Apr. 15, 1993, wherein the use of a pea starch as a stilt material was found to markedly reduce capsule rupture in the printing of carbonless paper in electrophotographic copiers.

Thus, an ability to run carbonless papers through electrophotographic copiers, copier/duplicators, and laser printers has been achieved, but has required the use of heavy basis weight paper (generally about 20 lbs.) or specially prepared xerographic paper. As mentioned earlier, high basis weight papers are disadvantageous when 4-part or greater carbonless paper form-sets are required. Thus, runnability has been achieved at the expense of manifolding. It would be desirable to have a carbonless paper which would provide carbonless sheets which lay flat, can run through photocopiers, are capable of double-sided copying, and exhibit good manifolding.

SUMMARY OF THE INVENTION

By the present invention it has been discovered that carbonless paper manufactured and cut in the grain-short direction and wherein the grain direction is parallel to the direction of feed when printed upon in electrophotographic copiers, copier/duplicators, and laser printers, results in fewer paper jams and less curl than carbonless paper manufactured and cut in the traditional grain-long direction. The use of grain-short cut carbonless paper also allows the use of lower basis weight papers and non-xerographic grade papers in electrophotographic copiers, copier/duplicators, and laser printers. Changing the paper fiber orientation (i.e., paper grain direction) of the coated paper being printed in electrophotographic copiers results in reduced paper jams and reduced curl in the printed paper.

Thus, in one embodiment, the present invention provides a novel process for the transfer of an image to the surface of a sheet of carbonless paper manufactured and cut in the grain-short direction. The inventive process comprises the steps of:

(a) generating a latent image on the surface of an imaging element;

(b) developing the latent image with toner; and (c) transferring the developed image to the surface of a sheet of carbonless paper manufactured as grain-short cut paper; wherein said grain-short carbonless paper has a base sheet basis weight of from about 16 lbs to about 20 lbs.

In a further embodiment, the present invention provides carbonless paper form-sets made by the foregoing disclosed inventive processes.

Grain-short cut carbonless paper may be used in any type of carbonless copy paper such as those which comprise coated donor (CB) and receptor (CF) sheets; those which comprise coated donor (CB), donor and receptor (CFB) and receptor (CF) sheets; and self-contained (SC) constructions.

By feeding carbonless copy paper with the fiber direction of the paper predominantly in the direction of the paper flow through the photocopier substantial and significant advantages in reduced jamming and in reduced curl in the printed sheet are obtained. Additionally, reduction in edge-corner folding and improved stacking due to lower paper curl is achieved. Surprisingly, an additional advantage is observed in that lower basis weight paper can be used in the copying process.

The inventive process provides for an easy and efficient way to produce carbonless paper-based products which are easy to handle, store, and transport. In view of the traditional problems encountered in the electrophotographic printing and publishing industry in the utilization of carbonless paper which were discussed earlier herein, the properties and advantages of the present invention were completely unexpected.

Other aspects, advantages, and benefits of the present invention are apparent from the detailed description, examples, and claims.

DETAILED DESCRIPTION OF THE INVENTION

Figure 1:
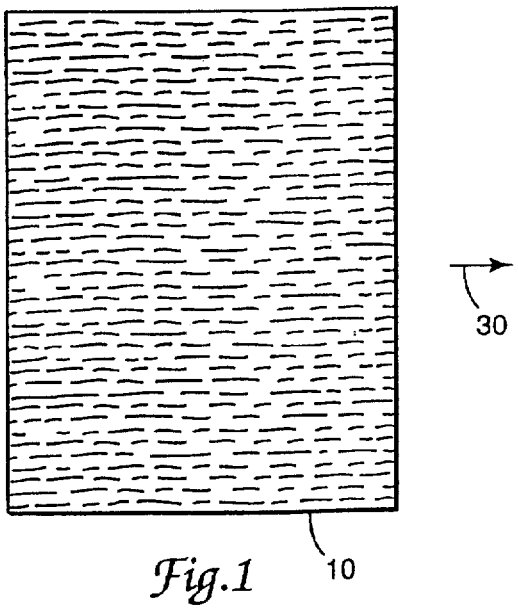
FIG. 1 illustrates a sheet of grain-short carbonless paper (10) wherein the grain of the paper is parallel to is width. Grain-short carbonless paper (10) is fed direction-wise (30) into a photocopier.
Figure 2:
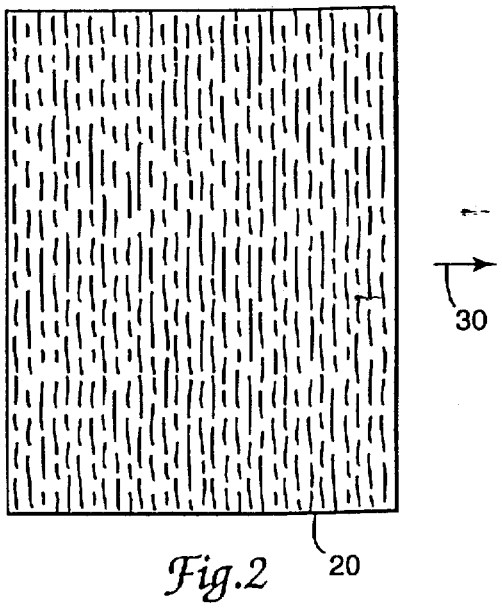
FIG. 2 illustrates a sheet of grain-long carbonless paper (20) wherein the grain of the paper is parallel to its length. Grain-long carbonless paper (20) is fed direction-wise (30) into a photocopier.

It has now been discovered that carbonless paper manufactured and cut in the grain-short direction when printed in electrophotographic copiers, copier/duplicators, and laser printers results in fewer paper jams and less curl than carbonless paper manufactured and cut in the traditional grain-long direction. The use of grain-short carbonless paper also allows the use of lower basis weight papers and non-xerographic grade papers in electrophotographic copiers, copier/duplicators, and laser printers. By changing the paper fiber orientation (i.e., paper grain direction) of the coated paper being printed in electrophotographic copiers, great improvements in reducing jams in the machine and in reducing the curl in the printed paper result.

The advent of high speed electrophotography and copiers having dependable, high capacity, collating systems has resulted in attempts to print carbonless papers on these machines. The use of electrophotography to print onto carbonless papers has met with limited success for a variety of reasons. One major problem encountered with printing onto carbonless papers using high speed copiers is paper curl and paper-jams. To overcome the problems encountered with the use of carbonless paper in electrophotographic copiers and printers, the carbonless papers used in electrophotography are of a high basis weight. As mentioned above, this is a disadvantage when carbonless paper is used to make form-sets of more than about three copies.

The use of lower basis weight papers increases the manifolding ability of a carbonless paper form-set. As mentioned above, manifolding is the number of sheets through which a legible image is reproduced. Manifolding is a function of the properties of both the carbonless imaging chemistry and the paper. For example, the hardness of the capsules as well as the color and density of the image formed all affect manifolding. Similarly, paper basis weight, caliper (thickness), moisture content, smoothness, surface barrier properties, porosity, stiffness, formation, and density, also affect manifolding.

As mentioned above, the papers used as base sheets in the manufacture of carbonless papers are different from the xerographic papers used in electrophotography. The xerographic papers used in electrophotography are of a higher basis weight than those used in carbonless papers. Paper basis weight, caliper (thickness), moisture content, smoothness, surface barrier properties, porosity, stiffness, electrical resistivity, and coefficient of friction, have all been optimized for their specific use. For example, the base sheets upon which color-forming coatings are applied in the manufacture of carbonless papers conventionally imaged via offset printing do not have sufficient stiffness or sufficient sensitivity to machine conditions for curl and moisture control to be handled in copier processors and sorters. Carbonless forms bond grade paper is a thinner, smoother, denser base sheet with better formation characteristics, and comparatively high water holdout properties, while xerographic bond grade has a lower moisture content, is less dense, and has a higher stiffness. A comparison of base sheet properties among a register forms bond, a xerographic bond, and a carbonless forms bond is shown below.

Base sheet Comparisons

| Property | Register Forms Bond | Xerographic Bond | Carbonless Forms Bond |
|---|---|---|---|
| Basis Weight (lbs per 500 sheet ream, 17" × 22") | 18.03 | 18.5 | 18.66 |
| Caliper, mils | 3.55 | 3.80 | 3.28 |
| % Moisture | 5.4 | 4.6 | 5.5 |
| Sheffield Smoothness (Felt side/Wire side) | 150/190 | 145 FS | 82/99 |
| Tear, grams (Machine/Cross Direction) | 43/45 | 44/48 | 38/46 |
| Hercules Size, seconds | 10 | 46 | 141 |
| Porosity, seconds | 18 | 20 | 21 |
| Coefficient of Friction, Static | | 0.52 | |
| Stiffness, Gurley (Machine/Cross Direction) | 122/63 | 182/70 | 138/63 |

-continued

Base sheet Comparisons

| Property | Register Forms Bond | Xerographic Bond | Carbonless Forms Bond |
|---|---|---|---|
| Apparent Density (Density = P/6.76 Caliper, mils P = Basis Wtg, lbs/ream) | 0.751 | 0.720 | 0.842 |
| Formation | Fair | Fair | Good |

The use of carbonless papers manufactured grain-short results in a surprisingly rigid sheet. Grain-short carbonless papers are much more capable of surviving stresses experienced in the routine handling of paper, particularly when paper is processed by machines such as sheet-fed high speed copiers, copier/duplicators, and laser printers. Grain-short carbonless papers also have the ability to lay flatter after going through the heat and pressure toner fusing process than similarly manufactured and imaged grain-long carbonless papers.

When paper is manufactured, the flow of the pulp along the paper making machine orients the paper fibers in the "machine direction" (i.e., the direction of the moving paper web of the paper machine). The direction perpendicular to the movement of the paper web is known as the "cross direction." The web is then slit into rolls and the rolls cut into sheets. In the traditional method of slitting and converting a paper web or paper rolls into sheets, the paper fibers in each sheet of paper are oriented parallel to the long dimension of the sheet. Thus, for example, in an 8½×11 inch sheet of paper, the paper fibers are parallel to the 11 inch edge of the sheet, that is, the paper fibers are aligned in the machine direction. A sheet thus prepared is said to be "grain-long." In contrast, sheets in which the paper fibers are parallel to the short dimension of the sheet are said to be "grain-short." The orientation of the paper fibers within a sheet of paper has a strong influence on the properties of the paper. For example, the stiffness of the sheet is greater in the direction parallel to the fibers' direction; dimensional stability changes more in the direction perpendicular to the direction of the paper fibers.

Numerous articles have appeared in the literature that discuss printing onto papers cut grain-short. These references, however, deal almost exclusively with the use of non-coated papers for offset printing. They do not discuss electrophotographic printing nor do they mention the advantages of using papers having a basis weight of less than about 20 lb or the use of non-xerographic base sheet papers. Nor do they discuss carbonless papers.

In discussing the effect of grain direction in non-xerographic printing, D. R. Voas, 1989 *Papermakers Conference*, pp. 299–302 states:

"grain direction and associated stiffness influence runnability. Small duplicators prefer grain long sheets (grain parallel to the paper flow through the press) so printed sheets will fall into the delivery pile without curling or rolling up like a mailing tube. Larger sheet-fed presses also generally prefer grain long (grain parallel to the printing cylinder axis) so heavy-weight sheets and board will more easily conform to the printing and transfer cylinders.)"

Grain direction of printed paper has been known to be important in an offset printed sheet. A report on "*Short Grain Web Offset*" (*Eur. Rotogravure Assoc. Newsl.* No. 87, Jan. 1988, pp. 3–4) states:

" . . . grain short allows either more production than long grain, or the same production at lower speeds making it easier to maintain consistent quality."

The functional properties of xerographic copy machine paper including basis weight is discussed in a paper given at a TAPPI conference (Charles J. Green, "*Functional Paper Properties in Xerography*," Printing and Reprographics Conference Proceedings, Chicago, Nov. 9–13, 1980, pp. 107–113). Green notes the important properties in Xerographic papers include stiffness, smoothness, electrical resistivity, porosity, coefficient of friction, and moisture content. He further notes that typically a minimum Taber CD stiffness of 1.2–1.4 mN is required for reliable paper handling. He then states that 75 g/m$^2$ papers (20 pound/ream) meet these requirements without difficulty, but 60 g/m$^2$ (16 pounds/ream) do not always meet these requirements especially if the paper is smooth. He further states that:

" . . . although it would seem desirable to feed paper long grain in the direction of higher stiffness, there are several important factors of overall performance which seem to dictate that feeding short grain is more desirable. (These include feeding, wrinkling, curl, and throughput.)."

This reference does not appear to lead to any firm conclusion as to the grain direction of the paper preferred for electrophotographic copying.

In contrast to the above however, Xerox Corporation's "*Helpful Facts About Paper,*" 1991 Edition, Section 3-8, entitled "Paper Properties and Xerox Printers," discusses the following about paper grain direction and its impact on Xerox printers:

"The grain should generally be parallel to the long side of the sheet for best printer performance. Such papers are said to be grain-long. Grain-long papers are about twice as stiff in the long direction (refer to "Stiffness," in the next section).

"Grain-short papers are about twice as stiff in the short direction. Papers cut grain-short do not flex as well as long-grain papers when running through the equipment. This can increase the frequency of paper feed problems in Xerox printers, especially those that feed paper long edge first. The difference in stiffness between the short and long directions tends to be extreme in short-grain papers, and incompatible curl patterns can be a problem."

This Xerox publication teaches the preferred use of papers cut grain-long and discourages the use of grain-short papers in Xerox equipment from both a runnability and curl standpoint, especially those photocopiers and copier/duplicators that feed paper long edge first such as the Xerox Model 5090 and 5100 high speed copier/duplicators.

None of the above publications are concerned with coated papers nor do they direct any attention to paper coated with reactive chemistry such as that coated on carbonless paper. The effect of printing upon paper coated with a polymeric binder and reactive solvent-containing capsules was not known and could only be speculated upon. Since the coating presumably covers the paper and contains a polymeric binder, one might expect the effect of the grain direction of the paper not to be important to the performance of the paper. The discovery that use of carbonless paper manufactured as grain-short paper and wherein the grain direction is parallel to the direction of feed gives decidedly less curl and improved runnability is contrary to the report in the Xerox reference. The particularly successful operation of lower basis weight paper comes as a surprise not expected upon examination of any of the above references. The significance of the use of lower basis weight paper has been pointed out as being important in preparing form-sets wherein 3 or more copies are made.

The use of carbonless papers manufactured and cut grain-short for electrophotographic copying as presently described is especially advantageous for low basis weight papers, because these papers have less rigidity which is necessary to provide good machine transport characteristics. Thus, the present invention is particularly advantageous for paper having a folio ream weight (i.e., basis weight) of 20 pounds or less. Standard bond paper weights for use in commercial photocopiers, have a "basis weight" of 20 to 28 pounds. Bond paper ream size is the weight of 500 sheets of 17 inch×22 inch paper. This is also the approximate weight in pounds/1,300 $ft^2$.

Prior to the present invention, when low basis weight carbonless paper was printed in electrophotographic copiers machine jamming was common and the paper had a significant curl upon leaving the copier.

In contrast to carbonless papers, standard xerographic bond papers printed in such copiers are usually 20 pound basis weight or higher and do not suffer from these problems. These sheets were all oriented in the grain-long mode, that is, the predominant fiber direction was in the long dimension of the paper.

Converting carbonless papers in the grain-short direction provides a lower cost method to obtain good electrophotographic machine performance and reduced post fuser curl on base sheet papers that are equal to or less than typical 20 lb (1,300 $ft^2$ basis-weight) weight construction and allows the use of less expensive non-xerographic base sheets, at 20 lbs. or lower weights, employed to obtain good machine performance.

The use of electrophotography, also known as xerography, to prepare plain paper copies of an original is well known and involves the use of a light-sensitive material known as a photoconductor. A photoconductor is a material that is an insulator in the dark and which has the property of being able to transport electric charge when exposed to light.

As mentioned earlier, the advent of high speed electrophotography and copiers having dependable, high capacity, collating systems, has resulted in attempts to print carbonless paper on these machines. In order for paper to function properly in a photocopier, a balance must be struck between the various properties that affect print quality and paper handling within the machine. These balances were discussed by Green in a paper on "Functional Paper Properties in Xerography" (see C. J. Green, *Tappi,* 1981, 64(5), 79–81). He noted that print quality and paper handling are related to the smoothness, electrical resistivity, curl (sheet flatness), stiffness, moisture content, porosity, friction, finish, and wax pick of the paper and that very often the requirements for print quality conflict with those for paper handling. For example, smooth papers give better fix (toner adhesion), but rough papers give better feed properties and paper transport.

M. Scharfe in *Electrophotography Principles and Optimization*; Research Studies Press, Ltd.: Letchworth, England, 1984; pp. 5–9 describes seven basic steps in the xerographic process. These steps include: charging the photoconductor; exposing it to light to produce an electrostatic latent image; developing the image; transferring the image to paper; fusing the toned image to paper; cleaning the photoconductor; and erasing the image.

In some high speed copier/duplicators this cycle takes place very rapidly and 90–135 copies/minute can be produced. This requires the copier/duplicator be in good adjustment and close tolerances be maintained and paper transport must be trouble free.

When carbonless paper is printed in an electrophotographic copier, paper jams and paper curl may occur at several places in the copier where pressure, close tolerances, and heat is used to facilitate movement of the sheet through the circuitous paper path of the copier and to fuse the toned image to the paper.

The first place where paper damage and paper jams may take place is the feed assembly station where paper is fed into the copier from the paper tray. Here, feed rollers introduce the top sheet from the stack of carbonless paper into the machine's paper path. The feeding of paper into printing presses or electrophotographic copiers depends upon individual sheets being fed from a stack of the paper, and the mode of transfer of the sheet into the printing press or photocopier varies with the machine. Printing presses and electrophotographic copiers are designed to feed paper into the machine by several mechanisms. The paper may be fed by a vacuum pickup and transfer system, by a roller or belt which exerts pressure on the top sheet in the stack, by a roller or belt which exerts pressure on the top sheet in the stack in combination with a retard roller or belt beneath the stack, or by other suitable means. The success in feeding single sheets depends upon cleanly separating each sheet from the sheet underneath without dragging the second sheet or multiple sheets into the printer. In the case of carbonless paper, there are several different types of sheets and the sheets have coatings which differ in surface character. Abrasion and resultant paper damage, bent and folded corners, and paper jams occur due to friction feeding between, for example, feed and retard belts and then as the paper is nipped between steel and polymeric rollers.

In one common mechanism, a roller or belt pressed against the top sheet of the paper stack is employed as the feed means. These feed means move into engagement with the top sheet of the stack, exert pressure on the top sheet, usually by buckling the sheet, and releases and separates the sheet from the stack. The sheet can then be fed through "take away rolls" into the copier. The feed means usually remain at a fixed position in relation to the stack during sheet feeding.

In another feed system, a forward moving belt removes the top sheet from a stack of paper and advances the sheet to a set of pinch rolls which then feed the sheet into the imaging and toner transfer stations. To prevent double feeds, a retard roller under the feed belt catches any second sheet that begins to transfer with the top sheet.

When carbonless papers are employed in feed mechanisms containing rollers, belts, or retard mechanisms, a smudge mark often develops on the CF surface of a sheet. Smudging is caused by CB capsule rupture and color-former transfer to the CF surface. Capsule rupture can be caused by the feed mechanism (such as a belt or roller) sliding across the paper. Capsule rupture can also be caused by double or multiple sheet feeds of carbonless papers into the feeder assembly and subsequent abrasion by the retard roller along the CB surface. Transfer of color-former from the CB sheet to the CF surface can take place in the paper feed mechanism as another sheet is fed, within the copier, or in the collection tray as the sheets lie on top of each other.

In general, lower basis weight papers are less capable of resisting stress. When low basis weight carbonless sheets are employed in feed mechanisms containing rollers, belts, or retard mechanisms, the sheets can crease, fold, or jam due to the pressure, buckling, pinching, grabbing, friction or other stresses induced by the feed mechanisms.

In the process of the present invention, a latent image can be generated on the surface of a suitable imaging element using an electrophotographic process. An "electrophotographic process" is one in which an electrostatic charge latent image is created by addressing a photoconductive surface with light. The photoconductor may be either organic or inorganic.

The latent image generated on the surface of the imaging element is developed with toner in any conventional manner, such as by electrophoretic or electrostatic deposition of the toner on the surface of the imaging element.

Another location for damage of carbonless paper sheets is at the toner transfer station where the developed image is then transferred from the surface of the photoconductor to the surface of the carbonless copy paper. Toner transfer may take place by any conventional method used in electrophotography such as by heat and/or pressure or the application of an electric field. The paper travels between the photoreceptor and a bias transfer roll where it is again subjected to shear and pressure forces. It is very important to have the copying machine in proper adjustment at this location to minimize paper jams, paper corner folding, and other forces which interfere with paper transport or cause capsule damage..

In the present invention any conventional solid or liquid toner can be used, although solid toners are preferred. Both types of toners are well known in the art and hence, do not require a great deal of elaboration herein. Solid toners typically contain a pigment or colorant, such as carbon black, either dispersed in or coated with a thermoplastic material. Liquid toners typically are in form of organosols comprising a pigment dispersed in a non-conductive, hydrocarbon medium.

Another important location where paper jamming and curl of the carbonless paper during the photocopying process occurs at the heat/pressure toner fusing station. Here, the surface temperature of the heat roller is about 204° C. (400° F.) and the pressure is thought to be about 140 psi. Heat and pressure can affect the carbonless coatings on the paper and are a particular source of paper curl. This type of curl is called "post-fuser curl" or "post-fuser reactivity."

The carbonless papers of the present invention have significantly improved resistance to curling tendencies upon passage through a photocopier. They are less subject to curl upon heating such as is encountered when fusing toner to the surface of the carbonless paper.

The use of grain-short carbonless papers in copiers and copier/duplicators results in a decrease in the number of "soft-folded corners." Soft-folded corners are folded corners in the sheets exiting from the copier. They can be single sheets or multiple sheets folded together. Soft-folded corners result from corners of curled paper getting caught within the copier at places where the paper must move between, for example, closely spaced guides, drums, or rollers. Soft-folded corners cause poor stacking in the collection bin. The reduction in soft-folded corners is most evident when using non-xerographic base sheets, but is also found with lower basis weight 18.5 lb xerographic base sheets. It should be noted, however, that no difference in soft folded corners exists between grain-short and grain-long 20 lb xerographic base sheets.

When carbonless paper manufactured grain short were imaged in a Xerox Model 5090 copier/duplicator, both simplex and duplex runnability performance were also improved. This improvement is most evident on the non xerographic base sheets that were evaluated. In many examples carbonless papers manufactured with paper grain in the traditional grain long direction would not run without continuous jamming when subjected to double sided copying (duplexing). A less noticable improvement to runnability was also found when using blue/purple carbonless coatings on 18.5 lbs basis weight register forms bond and xerographic bond paper.

The use of grain-short carbonless papers also improves sheet-stacking upon exiting the finishing station or collection tray of the copier, copier/duplicator, or laser printer. This reduction is most evident with non-xerographic base sheets, but is also noticeable with lower basis weight 18.5 lb xerographic base sheet. It should be noted, however, that no difference in sheet stacking is seen between grain-short and grain-long 20 lb xerographic base sheets.

The use of grain-short carbonless paper has also been found to be advantageous when the carbonless paper has been laser perforated prior to feeding it through the photocopier, copier/duplicator, or laser printer. This permits the manufacture of multi-part perforated carbonless paper form-sets (i.e., snap-out form-sets).

The present invention will be further described by reference to the following detailed examples. These examples are presented to illustrate the advantages and operation of the invention and are not to be construed as limiting its scope.

EXAMPLES

In the examples described below, the color-formers, encapsulation procedures, binders, and coating methods are similar to those described in U.S. Pat. Nos. 3,516,846 and 5,084,433, both incorporated herein by reference. 3M Scotchmark™ Carbonless Paper was obtained from 3M Company. It forms a black image.

Blue Purple Carbonless Papers were prepared as described in U.S. Pat. Nos. 3,576,846; 4,906,605; 5,084,433; EP Patent No. 0 569 285; and U.S. patent application Ser. No. 08/047,848 filed Apr. 15, 1993; all of which are incorporated herein by reference.

Curl was measured by hanging a sheet of carbonless paper above a sheet of paper placed upon a table. The corners and center-point of the edge of the curled sheet were marked on the flat sheet of paper. A line was drawn between the edge-points and the distance of the center-point above or below this line was measured.

The distance, in millimeters (mm) is recorded in the tables below as the amount of curl. If the plane of the top surface of the sheet (as it is feed into the copier) is taken as a reference, then curl can be of many types; front curl results when the sides of the sheet are higher that the center of the sheet; back curl results when the sides of the sheet are lower than the center of the sheet; cross direction front curl results when the front and back edges of the sheet are higher than the center of the sheet; and cross direction back curl results when the front and back edges of the sheet are lower than the center of the sheet.

The following definitions are used in the Examples:

MDA (Machine Direction Axial) is curl in the machine direction parallel to the paper grain.

CDA (Cross Direction Axial) is curl perpendicular to the machine direction of the paper grain.

Simplex indicates automatic feed of the paper with a single pass through the copier.

Duplex indicates automatic feed of the paper with a double pass through the copier (i.e., double sided copying).

All curl values are in millimeters

MDA is Machine Direction Axial Curl

MDB is Machine Direction Back Curl

CDB is Cross Direction Back Curl

MDF is Machine Direction Front Curl

Initial Curl is the curl in a sheet of paper before use in the copier.

Post-Fuser Curl is the curl in a sheet of paper after the toner has been fused to the paper and the paper has exited the copier.

ΔMDA (Change in Machine Direction Axial) is the change in curl upon going through photocopier and is the difference between initial curl and post-fuser curl.

ΔCurl is the change in curl upon going through photocopier and is the difference between initial curl and final curl. It may be toward the front (F) or back (B) of the sheet.

Examples 1–4

Sheets of 3M Scotchmark™ CFB 20 lb. Canary carbonless paper coated on 17 pounds/ream Register Form Bond (Georgia Pacific, Nekoosa, Wis.) were converted to 8½"× 11" sheets with the grain in two directions. In one set of samples the grain was in the standard direction, that is, parallel to the long axis of the paper (grain-long). In the second set of samples the grain was in the non-standard direction, that is, cut parallel to the short axis of the paper (grain-short). Thus, both papers were identical except for grain direction.

Experiments were run, each using up to 10,000 sheets of either grain-short or grain-long paper. Three different Xerox Model 5090 copier/duplicators were used. For each set of sheets, the curl before and after printing and the number of machine jams were noted. Results of these experiments shown below in Tables 1 and 2 demonstrate the following.

In all cases single-sided copying (i.e., simplex copying) on grain-short paper provides superior runnability when compared to single sided copying using the same paper manufactured grain-long. Grain-short papers also provide superior double-sided copying (i.e., duplex copying) when compared to double-sided copying using the same paper manufactured grain-long.

The incidence of soft-folded corners is significantly reduced with the use of grain-short papers.

Grain-short cut carbonless papers produce a much lower change in curl after feeding and printing than papers cut grain-long.

Examples 1 and 4 also demonstrate that performance improvements using grain-short cut carbonless papers are repeatable over time.

TABLE 1

Curl in Carbonless Paper Printed in Xerox Model 5090 Copier/Duplicator Scotchmark ™ 20 lb CFB Canary Carbonless Paper

| | | | Initial Curl | | Simplex Post-Fuser Curl | | | Number of Soft |
|---|---|---|---|---|---|---|---|---|
| Ex. | Grain Direction | Copier | MDA | CDA | MDA | CDA | ΔMDA | Folded Corners |
| 1. | Grain Long | A | −3 | −5 | −30 | 0 | −27 | 48/10,000 |
| | Grain Short | A | −3 | −1 | −9 | 0 | −6 | 2/10,000 |
| 2. | Grain Long | B | −2 | −5 | −30 | 0 | −28 | |
| | Grain Short | B | −0.7 | −2 | −13 | 0 | −12 | |
| 3. | Grain Long | C | −3 | 0 | would not run | | | |
| | Grain Short | C | −2 | −1 | −8 | 0 | −6 | |
| 4. | Grain Long | A | −3 | 0 | would not run | | | |
| | Grain Short | A | −2 | −1 | −16 | 0 | −14 | 4/10,000 |

TABLE 2

Paper Jams in Carbonless Paper Printed in Xerox Model 5090 Copier/Duplicator Scotchmark ™ 20 lb CFB Canary Carbonless Paper

| Ex. | Grain Direction | Copier | Number of Jams | Mean Number of Copies Between Jams | Duplex Copying (Double Side Copying) |
|---|---|---|---|---|---|
| 1. | Grain Long | A | 19/10,000 | 526 | Would Not Duplex Copy |
| | Grain Short | A | 0/10,000 | — | Would Duplex Copy |
| 2. | Grain Long | B | 9/1,000 | 111 | |
| | Grain Short | B | 23/10,000 | 435 | |
| 3. | Grain Long | C | 10/600 | 60 | |
| | Grain Short | C | 39/5,700 | 146 | |
| 4. | Grain Long | A | 16/800 | 90 | |
| | Grain Short | A | 0/10,000 | — | |

Examples 5–15

Three different carbonless paper constructions were prepared using different quality base sheets, manufactured on different paper machines and obtained from different paper mills. The base sheets were a xerographic bond, a Register Forms bond, and a carbonless bond. Teo basis weight papers were used, 20.0 lb, and 18.5 lb. The basis weight was for 500 sheets of paper 17"×22."

20.0 lb/ream basis weight Xerographic Bond (Georgia Pacific, Port Edwards, Wis.)

18.5 lb/ream basis weight Xerographic Bond (Georgia Pacific, Port Edwards, Wis.)

18.5 lb/ream basis weight Register Forms Bond (Georgia Pacific, Nekoosa, Wis.)

20.0 lb/ream Carbonless Oxford Bond (Boise Cascade, Rumford, Me.)

18.5 lb/ream Carbonless Oxford Bond (Boise Cascade, Rumford, Me.)

Examples 5–8

The following examples compare the reduction in curl using grain-short paper and grain-long paper in electrophotography.

Scotchmark™ CFB sheets were prepared by coating colorformers and developers on opposite sides of various base sheets. Example 5–8 shown below demonstrate curl change upon single-sided copying and toner fusing (i.e., simplex post-fuser curl change) is significantly lower for carbonless papers cut grain-short than for similar carbonless papers cut grain-long. In three of the four examples single sided copying (i.e., simplex runnability) was greatly improved by the use of carbonless papers cut grain-short. Printed sheet stacking quality was also improved with carbonless papers cut grain-short.

TABLE 3

Curl in Scotchmark ™ CFB Carbonless Paper Using Various Basis Weight Papers Printed in Xerox Model 5090 Copier/Duplicator - Copier B

| Ex. | Material | Initial Curl (mm) | Simplex Post-Fuser Curl (mm) | ΔCurl | Number of Soft-Folded Corners | Sheet Stacking |
|---|---|---|---|---|---|---|
| 5. | 20 lb Boise Cascade (Carbonless Oxford Bond) | | | | | |
| | Grain-long | 10.0 (MDB) | 45.0 (MDB) | 35 (B) | 44 (13.6/1,000) | Poor |
| | Grain-short | 16 (MDB) | 39 (MDB) | 23 (B) | 0 | Good |
| 6 | 18.5 lb Boise Cascade (Carbonless Oxford Bond) | | | | | |
| | Grain-long | 12.5 (MDB) | 50 (MDB) | 37.5 (B) | — | Poor |
| | Grain-short | 15 (MDB) | 40 (MDB) | 25 (B) | 0 | Good |
| 7 | 18.5 lb Georgia Pacific (Xerographic Bond) | | | | | |
| | Grain-long | 7.5 (MDB) | 37.5 (MDB) | 30 (B) | — | — |
| | Grain-short | 19 (MDB) | 37.5 (MDB) | 18.5 (B) | 13 (3.25/1,000) | Good |
| 8 | 18.5 lb Georgia Pacific (Register Forms Bond) | | | | | |
| | Grain-long | 2.5 (CDB) | 45 (MDB) | 42.5 (B) | — | Poor |
| | Grain-short | 2.5 (MDF) | 30 (MDF) | 32.5 (B) | — | Fair |

TABLE 4

Paper Jams in Scotchmark ™ CFB Carbonless Paper Printed in Xerox Model 5090 Copier/Duplicator

| Ex. | Grain Direction | Copier | Number of Jams | Mean Number of Copies Between Jams |
|---|---|---|---|---|
| 5. | 20 lb. Boise Cascade (Carbonless Oxford Bond) | | | |
| | Grain Long | B | 9/3,241 | 360 |
| | Grain Short | B | 0/4,000 | — |
| 6. | 18.5 lb Boise Cascade (Carbonless Oxford Bond) | | | |
| | Grain Long | B | 5/594 | 119 |
| | Grain Short | B | 3/4,000 | 1,333 |
| 7. | 18.5 lb. Georgia Pacific (Xerographic Bond) | | | |
| | Grain Long | B | 4/296 | 74 |
| | Grain Short | B | 0/4000 | — |
| 8. | 18.5 lb. Georgia Pacific (Register Forms Bond) | | | |
| | Grain Long | B | 6/2670 | 445 |
| | Grain Short | B | 6/413 | 69 |

Example 9–11

3M Blue/Purple Image 3-part straight sequence form sets were prepared by coating encapsulated ligand color-former and transition metal developer onto 20 lb basis weight Xerographic bond. The sheets were imaged using a Xerox Model 5090 copier/duplicator. Each sheet made a single pass through the copier (i.e. simplex copying). Three Xerox Model 5090 copier/duplicators were used. The results, shown below, demonstrate that with high basis weight papers such as 20 lb Xerographic bond, cutting the carbonless paper grain-short does not improve the runnability of the paper through the copier/duplicator. It was also found that with CB sheets, curl change (Δ Curl) appears to be only marginally improved with grain-short cut paper; with CFB sheets, curl change (Δ Curl) appears to be greater with grain-short paper, and with CF sheets, curl change (Δ Curl) appears to be similar when comparing papers cut grain-short and grain-long. Finally, with high basis weight xerographic grade papers, paper cut grain-short does not appear to improve stacking of the printed sheets in the collection tray.

TABLE 5

Curl in 3M Blue/Purple Carbonless Paper Using 20 lb Basis Weight Xerographic Bond

| Ex. | Material | Initial Curl (mm) | Simplex Post-Fuser Curl (mm) | ΔCurl | Number of Soft-Folded Corners | Sheet Stacking |
|---|---|---|---|---|---|---|
| 9. | Copier B - Grain-Long | | | | 0 | Good |
| | CB Sheets | 5 CDB | 5 MDF | 10 B | | |
| | CFB Sheets | 7.5 CDB | 9 MDB | 1.5 B | | |
| | CF Sheets | 14 MDF | 26 MDF | 12 F | | |
| | Copier B - Grain-Short | | | | 3 | Fair/Good |
| | CB Sheets | 2 MDF | 4 MDB | 6 B | | |
| | CFB Sheets | 7 MDB | 1 CDF | 8 F | | |
| | CF Sheets | 16 MDF | 22 CDF | 6 F | | |

TABLE 5-continued

Curl in 3M Blue/Purple Carbonless Paper Using 20 lb Basis Weight Xerographic Bond

| Ex. | Material | Initial Curl (mm) | Simplex Post-Fuser Curl (mm) | ΔCurl | Number of Soft-Folded Corners | Sheet Stacking |
|---|---|---|---|---|---|---|
| 10 | Copier C - Grain Long | | | | 0 | Good |
| | CB Sheets | 7.5 CDB | 17.5 MDB | 10 B | | |
| | CFB Sheets | 5 MDB | 12.5 MDB | 7.5 B | | |
| | CF Sheets | 15 MDF | 22.5 CDF | 7.5 F | | |
| | Copier C - Grain-Short | | | | 0 | Fair |
| | CB Sheets | 4 MDF | 0 (Flat) | 4 B | | |
| | CFB Sheets | 1 MDB | 18 CDF | 19 F | | |
| | CF Sheets | 14 MDF | 31 CDF | 17 F | | |
| 11 | Copier A - Grain-Long | | | | 2 | Fair |
| | CB Sheets | 7.5 CDF | 9 MDB | 16.5 B | | |
| | CFB Sheets | 5 F | 0 (Flat) | 5 B | | |
| | CF Sheets | 20 MDF | 25 MDF | 5 F | | |
| | Copier A - Grain-Short | | | | 0 | Fair |
| | CB Sheets | 2.5 CDF | 4.5 MDF | 2 F | | |
| | CFB Sheets | 1 MDB | 11 CDF | 12 F | | |
| | CF Sheets | 22 MDF | 25 CDF | 3 F | | |

TABLE 6

Paper Jams in 3M Blue/Purple Carbonless Paper Using 20 lb Basis Weight Xerographic Bond

| Ex. | Grain Direction | Copier | Number of Jams | Mean Number of Copies Between Jams |
|---|---|---|---|---|
| 9 | Grain Long | B | 0/4,000 | — |
| | Grain Short | B | 3/8,000 | 2,667 |
| 10 | Grain Long | C | 1/4,000 | 4,000 |
| | Grain Short | C | 7/8,000 | 1,143 |
| 11 | Grain Long | A | 0/4,000 | — |
| | Grain Short | A | 4/8,000 | 2,000 |

Examples 12–15

Examples 12–15 demonstrate that double-sided copying (i.e., duplex runnability) is significantly improved with carbonless papers cut grain-short.

3M Blue/Purple Image CFB carbonless sheets were prepared by coating encapsulated ligand color-former and transition metal developer on opposite sides of two different 18.5 lb base sheets (Register Forms Bond and Xerographic Bond). This improvement is probably due in part to a lowering of curl arising form the first pass through the machine (i.e., simplex post fuser curl). When single sided runnability is poor, as with 18.5 lb Register Forms Bond, cutting the paper in the grain-short direction improves machine performance. Examples 12 and 13 are made at different coater run conditions. This is also true with Examples 14 and 15.

TABLE 7

Curl in CFB Blue/Purple Carbonless Paper Using 18.5 lb Basis Weight Papers

| Ex. | Material | Initial Curl (mm) | Simplex Post-Fuser Curl (mm) | ΔCurl |
|---|---|---|---|---|
| 12 | 18.5 lb Georgia Pacific Register Forms Bond | | | |
| | Grain-Long | 7 MDB | 22 MDB | 15 B |
| | Grain-Short | 9 MDB | 5 MDB | 4 F |
| 13 | 18.5 lb Georgia Pacific Register Forms Bond | | | |
| | Grain-Long | 8 MDB | 26 MDB | 18 B |
| | Grain-Short | 19 MDB | 12 MDB | 7 F |
| 14 | 18.5 lb Georgia Pacific Xerographic Bond | | | |
| | Grain-Long | 9 CDB | 11 MDB | 2 B |
| | Grain-Short | 6 MDB | 2 MDB | 4 F |
| 15 | 18.5 lb Georgia Pacific Xerographic Bond | | | |
| | Grain-Long | 15 MDB | 22 MDB | 7 B |
| | Grain-Short | 11 MDB | 4 MDB | 7 F |

TABLE 8

Paper Jams in CFB Blue/Purple Carbonless Paper Printed in Xerox Model 5090 Copier/Duplicator

| Ex. | Grain Direction | Copier | Number of Jams Single Pass (simplex) | MNCBJ[1] | Number of Jams Double Pass (Duplex) | MNCBJ[1] |
|---|---|---|---|---|---|---|
| 12 | 18.5 lb Georgia Pacific Register Forms Bond | | | | | |
| | Grain Long | B | 7/10,000 | 1,429 | Would not run | |
| | Grain Short | B | 0/10,000 | — | 4/2000 | 500 |

TABLE 8-continued

Paper Jams in CFB Blue/Purple Carbonless Paper Printed in Xerox Model 5090 Copier/Duplicator

| Ex. | Grain Direction | Copier | Number of Jams Single Pass (simplex) | MNCBJ[1] | Number of Jams Double Pass (Duplex) | MNCBJ[1] |
|---|---|---|---|---|---|---|
| 13 | 18.5 lb Georgia Pacific Register Forms Bond | | | | | |
| | Grain Long | B | 12/10,000 | 833 | Would not run | |
| | Grain Short | B | 0/10,000 | — | 2/2,000 | 1,000 |
| 14 | 18.5 lb Georgia Pacific Xerographic Bond | | | | | |
| | Grain Long | B | 3/10,000 | 3,333 | Would not run | |
| | Grain Short | B | 3/10,000 | 3,333 | 1/2,000 | 2,000 |
| 15 | 18.5 lb Georgia Pacific Xerographic Bond | | | | | |
| | Grain Long | B | 0/10,000 | — | Would not run | |
| | Grain Short | B | 0/10,000 | — | 1/2,000 | 2,000 |

[1]MNCBJ is mean number of copies between jams

Examples 16–17

As noted above, the ability to form a good, dark image on a bottom sheet of a form-set from pressure applied on a top sheet, is known as "manifolding." The following examples demonstrate the difficulty in forming images on the bottom sheet of multi-part carbonless paper form-sets with papers having basis weights similar to those typically used in xerography. The comparison of manifolding on different base sheets was done using similar carbonless coatings with similar imaging properties (i.e., image intensity and sensitivity).

Example 16

Two different types of carbonless paper were prepared; a black image-forming encapsulated leuco dye color-former and acid developer system; and a blue/purple encapsulated ligand color-former and transition metal developer system. Color-former and developer were coated onto various types of paper to form CFB sheets and assembled into form-sets. The manifolding ability for a 4-, 5-, and 6-part form-set of carbonless paper was determined using a typewriter.

The results, shown below, demonstrate that the lower basis weight papers give better manifolding.

TABLE 9

Manifolding Comparisons - Typewritten Images

| Base Sheet | 4 Part Last Ply | 5 Part Last Ply | 6 Part Last Ply |
|---|---|---|---|
| | Image Quality using Black Image CFB | | |
| 17.0 lb Register Forms Bond | Good | Fair | Poor |
| 18.5 lb Carbonless Bond | Good | Fair | Poor |
| 20 lb Carbonless Bond | Fair | Poor | Very-Poor |
| 18.5 lb Register Forms Bond | Fair | Poor | Very-Poor |
| 18.5 lb Xerographic Bond | Fair | Poor | Very-Poor |
| 20# Xerographic Bond | Poor | Very-Poor | Very-Poor |
| | Image Quality using Blue/Purple Image CFB | | |
| 18.5 lb Xerographic Bond | Good | Fair | Poor |
| 20 lb Xerographic Bond | Fair | Very-Poor | Very-Poor |

Example 17

The manifolding ability under handwriting conditions was determined for multi-part form-sets of each of the carbonless paper sheets described above. The sheets were written upon by the same individual using four different writing instruments; a ball point pen manufactured by A. T. Cross, a roller pen manufactured by Papermate, a 0.07 mm lead pencil manufactured by Pental, and a #2 lead pencil. The results, shown below, demonstrate that the lighter basis weight papers give better manifolding.

TABLE 10

Manifolding Comparisons - Handwritten Images

| Base Sheet | 4 Part Last Ply | 5 Part Last Ply | 6 Part Last Ply |
|---|---|---|---|
| | Image Quality using Black Image CFB | | |
| 17.0 lb Register Forms Bond | Legible | Legible | Barely Legible |
| 18.5 lb Carbonless Bond | Legible | Barely Legible | Not Legible |
| 18.5 lb Xerographic Bond | Legible | Barely Legible | Not Legible |
| 18.5 lb Register Forms Bond | Legible | Barely Legible | Not Legible |
| 20 lb Carbonless Bond | Barely Legible | Not Legible | Not Legible |
| 20 lb Xerographic Bond | Barely Legible | Not Legible | Not Legible |
| | Image Quality using Blue/Purple Image CFB | | |
| 18.5 lb Xerographic Bond | Legible | Barely Legible | Not Legible |
| 20 lb Xerographic Bond | Barely Legible | Not Legible | Not Legible |

Reasonable variations and modifications are possible from the foregoing disclosure without departing from either the spirit or scope of the present invention as defined in the claims.

What is claimed is:

1. A process for the transfer of an image comprising the steps of:

(a) generating a latent image on the surface of an imaging element;

(b) developing said latent image with toner;

(c) transferring said developed image to the surface of a sheet of carbonless paper manufactured grain-short; wherein said grain-short carbonless paper has a base sheet basis weight of from about 16 lbs to about 20 lbs.

2. The process according to claim 1 wherein said imaging element is a dielectric material.

3. The process according to claim 1 wherein said imaging element is a photoconductor.

4. The process according to claim 1 wherein said toner is in the form of a powder.

5. The process according to claim 1 wherein said toner is liquid.

6. The process according to claim 1 wherein said transfer step in (c) is conducted with heat and pressure.

7. The process according to claim 1 wherein said transfer step in (c) is conducted in the presence of an electric field.

8. The process according to claim 1 wherein said carbonless paper comprises a donor sheet and a receptor sheet.

* * * * *

UNITED STATES PATENT AND TRADEMARK OFFICE

CERTIFICATE OF CORRECTION

PATENT NO. :5,991,588
DATED :Nov. 23, 1999
INVENTOR(S) :Kraft

It is certified that error appears in the above-identified patent and that said Letters Patent is hereby corrected as shown below:

First page, right-hand column, under the abstract, "8 Claims, No Drawings" should be --8 Claims, 1 Drawing Sheet--.

Signed and Sealed this

Sixth Day of February, 2001

*Attest:*

*Attesting Officer*

Q. TODD DICKINSON

*Director of Patents and Trademarks*